US006856234B2

(12) United States Patent
Kuriyama et al.

(10) Patent No.: US 6,856,234 B2
(45) Date of Patent: Feb. 15, 2005

(54) CHIP RESISTOR

(75) Inventors: Takahiro Kuriyama, Kyoto (JP); Masato Doi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 10/786,796

(22) Filed: Feb. 23, 2004

(65) Prior Publication Data

US 2004/0164842 A1 Aug. 26, 2004

(30) Foreign Application Priority Data

Feb. 25, 2003 (JP) ..... 2003-047517

(51) Int. Cl.[7] ..... H01C 1/012

(52) U.S. Cl. ..... 338/309; 338/313; 338/314; 338/328; 338/332

(58) Field of Search ..... 338/309, 313, 338/314, 325, 324, 328, 332

(56) References Cited

U.S. PATENT DOCUMENTS 4,684,916 A * 8/1987 Ozawa ..... 338/308
6,023,217 A * 2/2000 Yamada et al. ..... 338/309
6,492,896 B2 * 12/2002 Yoneda ..... 338/309
6,636,143 B1 * 10/2003 Hashimoto et al. ..... 338/309
6,703,683 B2 * 3/2004 Tanimura ..... 257/536
6,724,295 B2 * 4/2004 Tsukada ..... 338/309
6,727,798 B2 * 4/2004 Akhtman et al. ..... 338/309
2003/0114258 A1 * 6/2003 Tucker ..... 473/513
2003/0117258 A1 * 6/2003 Kim et al. ..... 338/309
2003/0156008 A1 * 8/2003 Nakanishi et al. ..... 338/309

FOREIGN PATENT DOCUMENTS

EP 0810614 * 12/1997
JP 08-236302 9/1996
JP 2000-173802 * 6/2000

* cited by examiner

*Primary Examiner*—Karl D. Easthom
(74) *Attorney, Agent, or Firm*—Merchant & Gould P.C.

(57) ABSTRACT

A chip resistor includes an insulating substrate 2 in the form of a chip having an upper surface and an opposite pair of side surfaces, a resistor film 4 formed on the upper surface of the insulating substrate 2, a pair of upper electrodes 5 formed on the upper surface of the insulating substrate 2 to flank the resistor film 4 in electrical connection thereto, a cover coat 6 covering the resistor film 4, an auxiliary upper electrode 7 formed on each of the upper electrodes 5 and including a first portion 7*a* adjoining the relevant side surface of the insulating substrate 2 and a second portion 7*b* overlapping the cover coat 6, and a side electrode 8 formed on each of the side surfaces of the insulating substrate 2 and electrically connected to at least the upper electrode 5 and the auxiliary upper electrode 7. The first portion 7*a* of the auxiliary upper electrode 7 has an obverse surface positioned higher than an obverse surface of the second portion 7*b* for projecting above an obverse surface of the cover coat 6.

3 Claims, 3 Drawing Sheets

CHIP RESISTOR

BACKGROUND OF THE INVENTION

1. Field of the Invention

The present invention relates to a chip resistor comprising an insulating substrate in the form of a chip, at least one resistor film formed on the substrate, a pair of terminal electrodes formed on the substrate to flank the resistor film, and a cover coat covering the resistor film.

2. Description of the Related Art

Conventionally, in a chip resistor of the above-described type, the cover coat covering the resistor film projects largely from a central portion of the upper surface of the insulating substrate, thereby providing stepped portions in the chip resistor. Therefore, when such a chip resistor is mounted on a printed circuit board with the resistor film facing the printed circuit board, the chip resistor is often disadvantageously inclined with one end thereof rising to be away from the circuit board.

JP-A-8-236302 discloses a chip resistor capable of solving such a problem. Specifically, as shown in FIG. 9 of JP-A-8-236302, the disclosed chip resistor is provided with auxiliary upper electrodes formed on the upper electrodes provided at opposite ends of the resistor film to partially overlap the cover coat. With such an arrangement, no stepped portions or only small stepped portions are provided in the chip resistor, whereby the chip resistor is prevented from inclining when mounted on a printed circuit board with the resistor film facing the printed circuit board.

However, in such a prior art chip resistor, the auxiliary upper electrodes do not project largely relative to the obverse surface of the cover coat. Therefore, when the chip resistor is mounted on a printed circuit board with the resistor film facing the printed circuit board, the cover coat is brought into contact with or comes too close to the printed circuit board. Since the printed wiring board in such a state is likely to be influenced by the heat generated at the heat resistor, the rated value of the chip resistor cannot be enhanced. Further, since the auxiliary upper electrodes do not project largely relative to the obverse surface of the cover coat, the insulating substrate is also located close to the printed wiring board. Therefore, the difference in thermal expansion between the insulating substrate and the printed circuit board cannot be absorbed, which results in removal of electrodes from the insulating film.

The above problems may be solved when a portion of the auxiliary upper electrode, which overlaps the cover coat, is bulged so that the upper surface of that portion becomes higher than the obverse surface of the cover coat. In such a case, however, when the chip resistor is mounted on a printed circuit board, a gap is defined between the printed circuit board and opposite ends of the chip resistor. In soldering, therefore, there is an increased possibility that the chip resistor is inclined with one of the opposite ends rising from the printed circuit board.

However, to make the entirety of the auxiliary upper electrode thick for making the upper surface thereof higher than the obverse surface of the cover coat, a larger amount of material need be used for making the auxiliary upper electrode, which leads to an increase of the manufacturing cost.

SUMMARY OF THE INVENTION

An object of the present invention is to solve the above-described problems.

According to a first aspect of the present invention, there is provided a chip resistor comprising an insulating substrate in the form of a chip having an upper surface and an opposite pair of side surfaces, a resistor film formed on the upper surface of the insulating substrate, a pair of upper electrodes formed on the upper surface of the insulating substrate to flank the resistor film in electrical connection thereto, a cover coat covering the resistor film, an auxiliary upper electrode formed on each of the upper electrodes and including a first portion adjoining a corresponding one of the side surfaces of the insulating substrate and a second portion overlapping the cover coat, and a side electrode formed on each of the side surfaces of the insulating substrate and electrically connected to at least a corresponding one of the upper electrodes and a corresponding one of the auxiliary upper electrodes. The first portion of the auxiliary upper electrode has an obverse surface positioned higher than an obverse surface of the second portion for projecting above an obverse surface of the cover coat.

With such a structure, when the chip resistor is onto a printed circuit board with the resistor film facing the printed circuit board, the higher portions of the auxiliary upper electrodes come into contact with electrode pads provided on the printed circuit board. Therefore, the cover coat as well as the insulating substrate can be spaced from the printed circuit board due to the height difference between the higher portion of each auxiliary upper electrode and the obverse surface of the cover coat, so that a gap is unlikely to be formed between each end of the chip resistor and the printed circuit board.

Moreover, since the portion of each auxiliary electrode overlapping the relevant end of the cover coat is made thinner than the portion adjoining the side surface of the insulating substrate, the auxiliary upper electrode can be made using a smaller amount of material than when the auxiliary upper electrode is entirely made thick.

According to the present invention, therefore, the rated value of the resistor chip can be enhanced without increasing the manufacturing cost. Moreover, it is possible to prevent the rising of one end of the chip resistor and the unexpected removal of electrodes from the insulating substrate when the chip resistor is mounted on a printed circuit board.

In a preferred embodiment, the auxiliary upper electrode may be made of a conductive paste mainly containing a base metal. In another preferred embodiment, the auxiliary upper electrode may be made of a carbon-based conductive resin paste.

With such a feature, corrosion due to e.g. sulfur in the atmosphere does not occur at the auxiliary upper electrodes, whereby corrosion of the upper electrodes can be reliably prevented. Therefore, the upper electrodes can be made relatively thin, which leads to reduction of the manufacturing cost.

Other features and advantages of the present invention will become clearer from the detailed description given below with reference to the accompanying drawings.

DETAILED DESCRIPTION OF THE PREFERRED EMBODIMENTS

Figure 1:
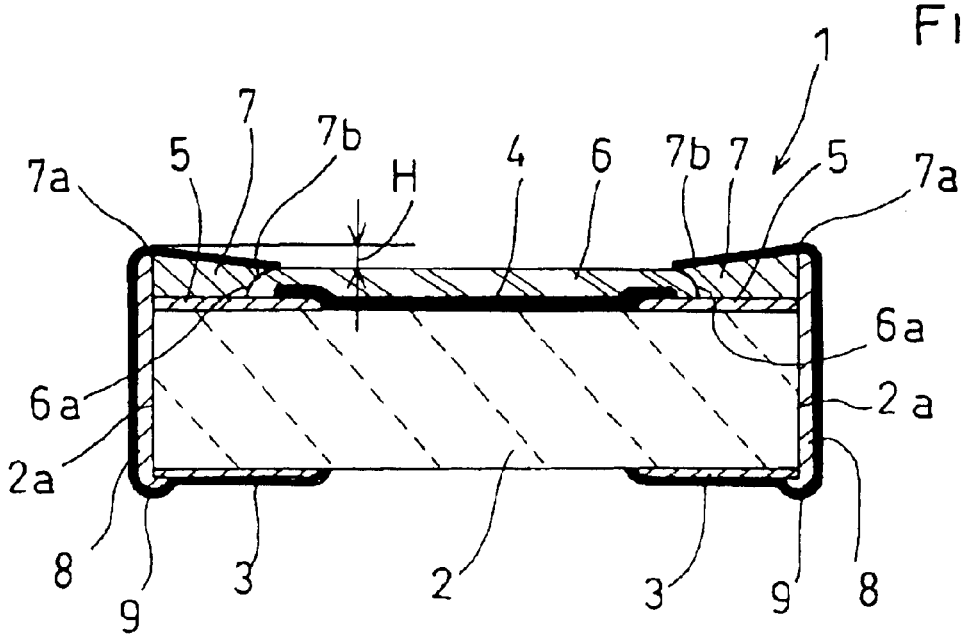
FIG. 1 is a sectional view illustrating a chip resistor according to an embodiment of the present invention.

A chip resistor 1 according to an embodiment of the present invention includes an insulating substrate 2 in the form of a chip made of a heat-resistant material such as ceramic material. The insulating substrate 2 has a lower surface provided with a pair of lower electrodes 3 made of a conductive paste mainly composed of silver, which has a relatively low electric resistance. (Hereinafter, the paste is referred to as "silver-based conductive paste".) The insulating substrate 2 has an upper surface formed with a resistor film 4, and a pair of upper electrodes 5 flanking and connected to the resistor film 4. The upper electrodes 5 are also made of a silver-based conductive paste. The chip resistor 1 further includes a cover coat 6 made of e.g. glass for covering the resistor film 4. The cover coat 6 overlaps part of each of the upper electrodes 5.

Each of the upper electrodes 5 has an upper surface formed with an auxiliary upper electrode 7 made of a silver-based conductive paste. The auxiliary upper electrode 7 overlaps a corresponding end 6*a* of the cover coat 6. The insulating substrate 2 has opposite side surfaces 2*a* each of which is formed with a side electrode 8 electrically connected to at least the lower electrode 3 and the auxiliary upper electrode 7.

The chip resistor is further provided with a pair of metal plating layers 9 each covering the lower electrode 3, the auxiliary upper electrode 7 and the side electrode 8. Each metal plating layer 9 may consist of an underlying nickel plating layer and a soldering layer formed by plating with tin or solder for example.

Each of the auxiliary upper electrodes 7 formed on the upper electrodes 5 is higher at a portion 7*b* adjoining the relevant side surface of the insulating substrate 2 than at another portion 7*b* overlapping the end 6*a* of the cover coat 6. Thus, the obverse surface of the portion 7*a* is made higher than that of the cover coat 6 by a predetermined amount H.

Figure 2:
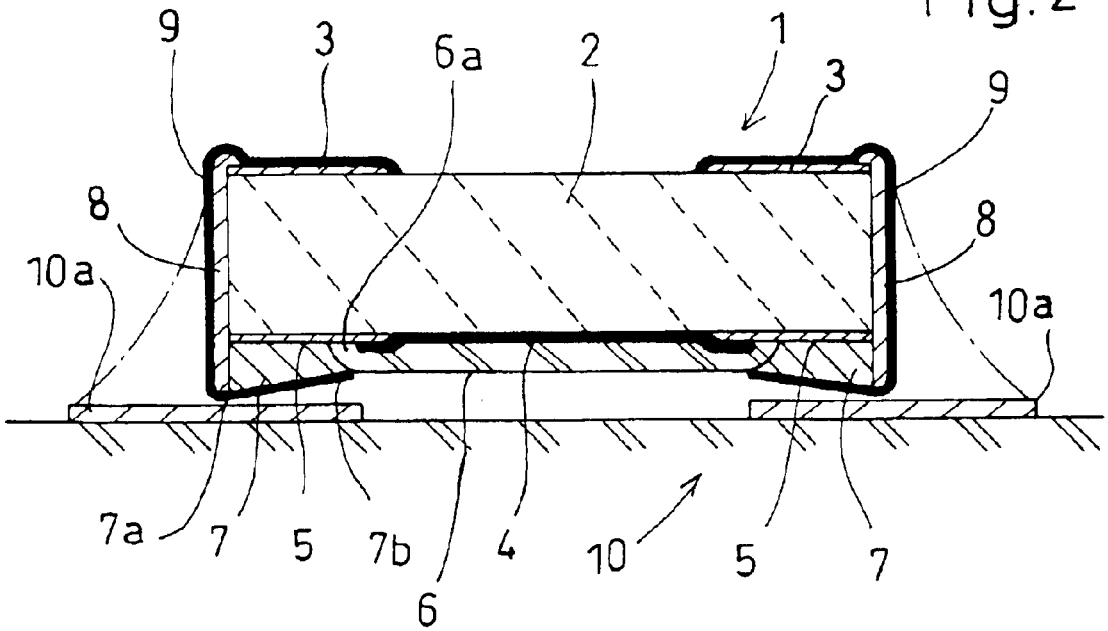
FIG. 2 is a sectional view of the chip resistor mounted on a printed circuit board.

As shown in FIG. 2, when the chip resistor 1 having the above-described structure is mounted onto a printed circuit board 10 with the resistor film 4 facing the printed circuit board 10, the higher portions 7*a* of the auxiliary upper electrodes 7 come into contact with electrode pads 10*a* provided on the printed circuit board 11. Therefore, the cover coat 6 as well as the insulating substrate 2 can be spaced from the printed circuit board 10 due to the height difference H between the higher portion of each auxiliary upper electrode 7 and the obverse surface of the cover coat 6, so that a gap is unlikely to be formed between each end of the chip resistor 1 and the printed circuit board 10.

As noted above, the portion 7*b* of each auxiliary upper electrode 7 overlapping the relevant end 6*a* of the cover coat 6 is made thinner than the portion 7*a* adjoining the side surface 2*a* of the insulating substrate 2. Therefore, the auxiliary upper electrode 7 can be made using a smaller amount of material than when the auxiliary upper electrode 7 is entirely made thick.

The chip resistor 1 may be made by the following process steps.

Figure 3:
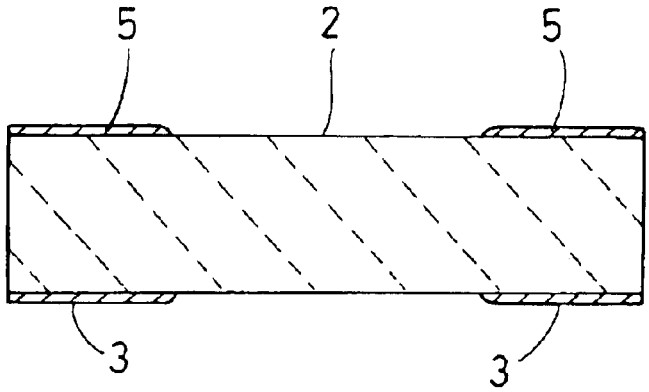
FIG. 3 illustrates a first step of the manufacturing process of the chip resistor.

In a first step, lower electrodes 3 and upper electrodes 5 are formed on an insulating substrate 2 by screen-printing a silver-based conductive paste and then baking the paste at high temperature, as shown in FIG. 3. In this step, the lower electrodes 3 may be formed before forming the upper electrodes 5. Alternatively, the lower electrodes 3 and the upper electrodes 5 may be formed simultaneously.

Figure 4:
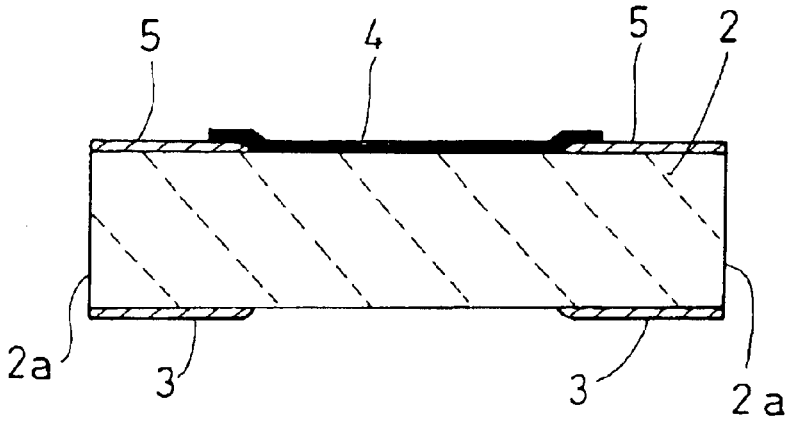
FIG. 4 illustrates a second step of the manufacturing process of the chip resistor.

Subsequently, in a second step, a resistor film 4 is formed on the upper surface of the insulating substrate 2 by screen-printing an appropriate paste and then baking the paste at high temperature, as shown in FIG. 4.

Thereafter, the resistor film 4 is subjected to trimming for adjusting the resistance to an appropriate value.

Figure 5:
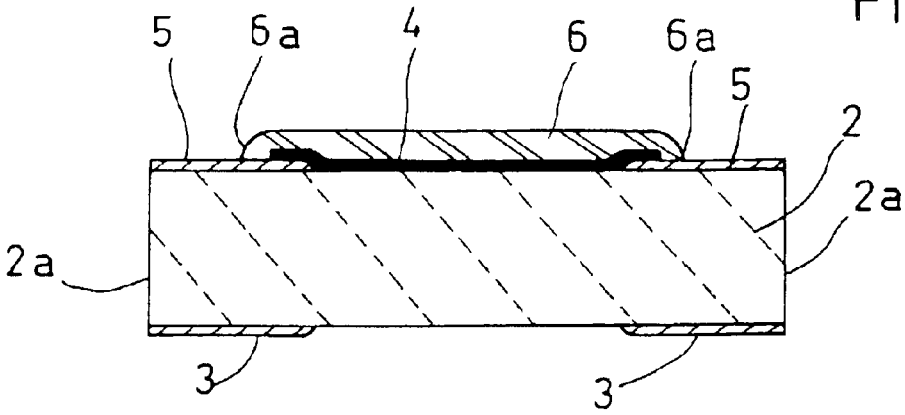
FIG. 5 illustrates a third step of the manufacturing process of the chip resistor.

Then, in a third step, a cover coat 6 to cover the resistor film 4 is formed on the insulating substrate 2 by screen-printing a glass paste and then baking the paste at the softening temperature of the glass, as shown in FIG. 5.

Figure 6:
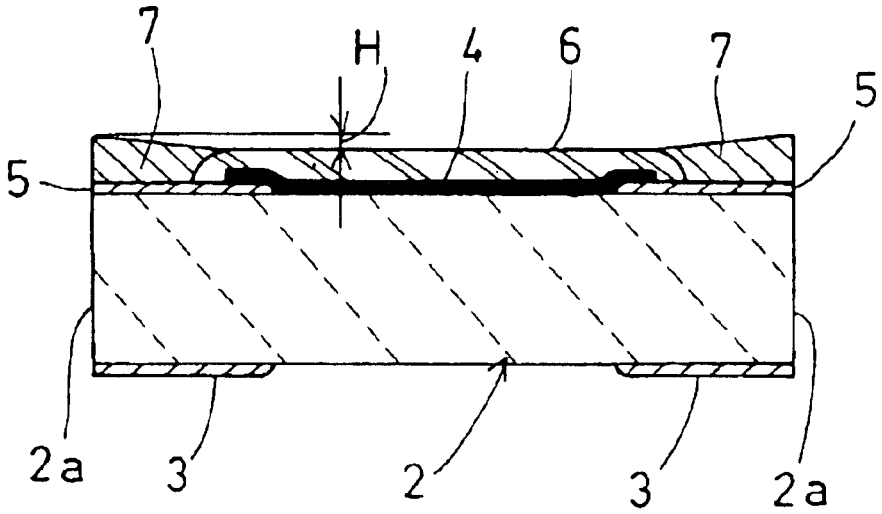
FIG. 6 illustrates a fourth step of the manufacturing process of the chip resistor.

Subsequently, in a fourth step, auxiliary upper electrodes 7 are formed on the upper electrodes 5 by screen-printing a silver-based conductive paste and then baking the paste at high temperature, as shown in FIG. 6.

Figure 7:
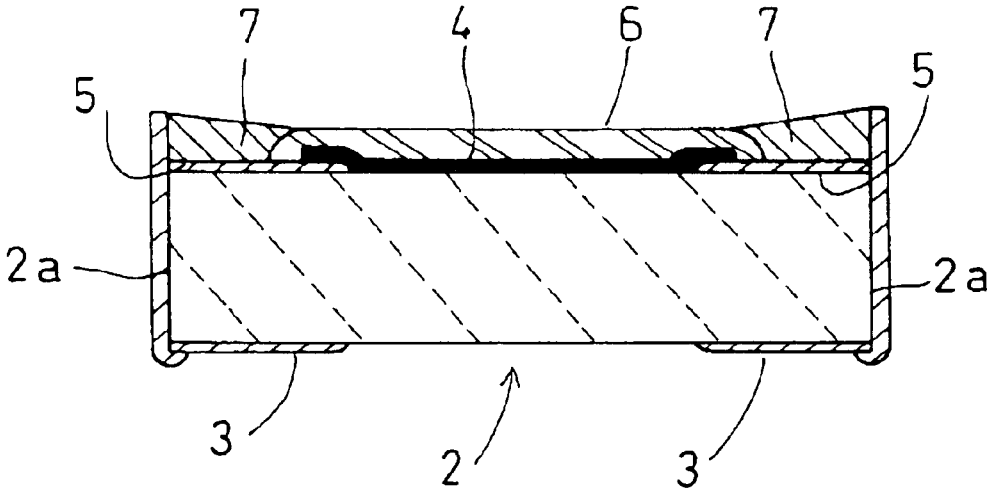
FIG. 7 illustrates a fifth step of the manufacturing process of the chip resistor.

Then, in a fifth step, side electrodes 8 are formed on opposite side surfaces 2*a* of the insulating substrate 2 by screen-printing a silver-based conductive paste and then baking the paste at high temperature, as shown in FIG. 7

Finally, in a sixth step, metal plating layers 9 are formed to cover the lower electrodes 3, the auxiliary upper electrodes 7 and the side electrodes 8.

In place of a silver-based conductive paste, the auxiliary upper electrodes 7 may be made of a conductive paste mainly composed of a base metal such as nickel or copper (base-metal-based conductive paste). Alternatively, the auxiliary upper electrodes 7 may be made of a resin paste containing carbon powder for providing conductivity (carbon-based conductive resin paste).

When the auxiliary upper electrodes 7 are made of a base-metal-based paste or carbon-based conductive resin paste, corrosion due to e.g. sulfur in the atmosphere does not occur at the auxiliary upper electrodes 7, whereby corrosion of the upper electrodes 5 can be prevented.

In the case where the auxiliary upper electrodes 7 are to be made of a carbon-based conductive resin paste, the auxiliary upper electrodes 7 are formed by screen-printing the resin paste and then hardening the paste by baking, for example, after the cover coat 6 is formed. Thereafter, side electrodes 8 are formed by screen-printing a conductive resin paste containing carbon-based conductive resin paste and then hardening the paste by baking, for example. Finally, metal plating layers 10 are formed to complete the chip resistor.

What is claimed is:

1. A chip resistor comprising:

an insulating substrate in a form of a chip having an upper surface and an opposite pair of side surfaces;

a resistor film formed on the upper surface of the insulating substrate;

a pair of upper electrodes formed on the upper surface of the insulating substrate to flank the resistor film in electrical connection thereto;

an outermost cover coat covering the resistor film and having an outermost surface;

an auxiliary upper electrode formed on each of the upper electrodes and including an outer edge adjoining a corresponding one of the side surfaces of the insulating substrate and an inner edge held in direct contact with the outermost surface of the outermost cover coat; and a side electrode formed on each of the side surfaces of the insulating substrate and electrically connected to at least a corresponding one of the upper electrodes and a corresponding one of the auxiliary upper electrodes;

wherein said outer edge of the auxiliary upper electrode projects beyond the outermost surface of the outermost cover coat, the auxiliary upper electrode having a thickness that decreases progressively from said outer edge to said inner edge such that the thickness of the auxiliary upper electrode is maximum at said outer edge and minimum at said inner edge.

2. The chip resistor according to claim 1, wherein the auxiliary upper electrode is made of a conductive paste containing a base metal.

3. The chip resistor according to claim 1, wherein the auxiliary upper electrode is made of a carbon-based conductive resin paste.

* * * * *